US006912898B2

(12) United States Patent
Jones et al.

(10) Patent No.: US 6,912,898 B2
(45) Date of Patent: Jul. 5, 2005

(54) USE OF CESIUM AS A TRACER IN CORING OPERATIONS

(75) Inventors: Christopher Jones, Houston, TX (US); Jon Burger, Houston, TX (US); Patrick Jacobs, Houston, TX (US); Richard J. Drozd, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/614,850

(22) Filed: Jul. 8, 2003

(65) Prior Publication Data

US 2005/0005694 A1 Jan. 13, 2005

(51) Int. Cl.[7] ..... E21B 49/00
(52) U.S. Cl. ..... 73/152.11
(58) Field of Search ..... 73/152.07, 152.09, 73/152.11, 37, 38; 250/255

(56) References Cited

U.S. PATENT DOCUMENTS

| | | | | | |
|---|---|---|---|---|---|
| 4,174,629 | A | | 11/1979 | Striegler | 73/153 |
| 4,486,714 | A | * | 12/1984 | Davis et al. | 324/376 |
| 4,540,882 | A | * | 9/1985 | Vinegar et al. | 250/255 |
| 4,555,934 | A | * | 12/1985 | Freeman et al. | 73/38 |
| 4,574,887 | A | | 3/1986 | Abdo | 166/275 |
| 4,691,772 | A | * | 9/1987 | Ebenhack et al. | 166/250.02 |
| 4,790,180 | A | * | 12/1988 | Sinnokrot | 73/152.07 |
| 4,961,343 | A | * | 10/1990 | Boone | 73/152.03 |
| 4,982,604 | A | * | 1/1991 | Davis et al. | 73/152.11 |
| 5,027,379 | A | * | 6/1991 | Hunt et al. | 378/4 |
| 5,164,590 | A | * | 11/1992 | Coles et al. | 250/255 |
| 5,297,420 | A | * | 3/1994 | Gilliland et al. | 73/38 |
| 6,039,128 | A | | 3/2000 | Brunato | 175/70 |
| 6,177,014 | B1 | | 1/2001 | Potter et al. | 210/615 |
| 6,177,396 | B1 | * | 1/2001 | Clapperton et al. | 510/405 |
| 6,220,371 | B1 | | 4/2001 | Sharma et al. | 175/50 |
| 6,283,228 | B2 | * | 9/2001 | Collee et al. | 175/58 |
| 6,423,802 | B1 | * | 7/2002 | Miller et al. | 526/287 |
| 6,492,305 | B2 | | 12/2002 | Sifferman | 507/212 |
| 6,495,493 | B1 | | 12/2002 | Cobianco et al. | 507/110 |
| 2004/0162224 | A1 | * | 8/2004 | Nguyen et al. | 507/200 |
| 2004/0169511 | A1 | * | 9/2004 | Minh et al. | 324/303 |
| 2004/0209781 | A1 | * | 10/2004 | Harris | 507/200 |

FOREIGN PATENT DOCUMENTS

| | | | | |
|---|---|---|---|---|
| EP | 1254942 A2 | * | 11/2002 | C09K/7/02 |
| GB | 2277338 A | * | 10/1994 | C09K/7/02 |

OTHER PUBLICATIONS

Thomas, *A Beginner's Guide to ICP–MS Part 1* Spectroscopy 16(4) Apr. 2001 (4 p.).

*Safety Data Sheet According to EC directive 2001/58/EC* (6 p) Jan. 6, 2003.

*Coring Systems* Brochure Security DBS 1998 (9 p.).

*Coring Brochure* Coring Services 1994 (18 p.).

*Low Invasion Corehead reduces Mud Invasion while improving Performances* Journal of Energy Resources Technology vol. 116, Dec. 1994 (pp. 258–267).

Cesium Formate Product Bulletin [online] Retrieved from the Internet:>UR1: www.cabot–corp.com (2 p.) 2002.

* cited by examiner

*Primary Examiner*—Hezron Williams
*Assistant Examiner*—John Fitzgerald
(74) *Attorney, Agent, or Firm*—Conley Rose, P.C.

(57) ABSTRACT

A method for measuring the infiltration of coring fluid into a core sample taken from a formation comprises a) providing a coring fluid containing cesium in a first concentration, b) using the coring fluid and a coring means to generate the core sample, c) determining the concentration of cesium present in the core sample; and d) comparing the core sample cesium concentration to the first concentration. A further preferred step comprises using the comparison in step d) to calculate the degree of infiltration of the coring fluid into the core sample.

20 Claims, No Drawings

USE OF CESIUM AS A TRACER IN CORING OPERATIONS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

In order to recover fluid materials such as gaseous or liquid hydrocarbons and the like from geological formations in the earth's crust it is common to drill a well from the surface into the formation. The well is drilled into the ground and directed to the targeted geological location from a drilling rig at the surface. Typically, the drilling rig rotates a drillstring so as to rotate a bottom hole assembly (BHA) that includes a drill bit connected to the lower end of the drillstring. During drilling, a drilling fluid, commonly referred to as drilling mud, is pumped and circulated down the interior of the drillpipe, through the BHA and the drill bit, and back to the surface in the annulus.

Once the bit has reached the formation of interest, it is common to investigate the properties of the formation, such as porosity, permeability, and composition of formation fluids, by obtaining and analyzing a representative sample of rock from the formation. The sample is generally obtained by replacing the drilling bit with a cylindrical coring bit, and the sample obtained using this method is generally referred to as a core sample. Once the core sample has been transported to the surface, the core sample can be analyzed to evaluate the reservoir storage capacity (porosity), the flow potential permeability) of the rock that makes up the formation, the composition of the fluids that reside in the formation, and to measure irreducible water content. These estimates are used to design and implement well completion; that is, to selectively produce certain economically attractive formations from among those accessible by the well. Once a well completion plan is in place, the other strata in the formation are isolated from the target formations, and the fluids within targeted formations are produced through the well. Core samples and information obtained therefrom play an important role in assessing the formation and thus determining how best to produce the formation fluids.

Rotary coring is a common technique for sampling downhole formations. In rotary coring, a hollow cylindrical coring bit is rotated against bottom or, less commonly, the sidewall of the borehole. Coring bits are well known in the art. As the bit penetrates the formation, a core sample is cut and is received in the hollow barrel of the coring bit. After the desired length of the core sample or the maximum capacity of the core bit is reached, the core sample may be broken free of and retrieved to the surface for analysis. Some attempts have been made to provide downhole analysis of the core, but none have been entirely satisfactory.

Even when analysis of the core sample is conducted at the surface, one difficulty remains a particular problem. Namely, the fluid that is used to cool the bit and carry away the formation cuttings, typically a mud, tends to infiltrate the formation rock, including the rock that forms the core sample, because of the large hydrostatic head of fluid that exists downhole.

The drilling fluid typically comprises a water- or oil-based solution in which particles having a desired composition are suspended. The ingredients in the drilling fluid are typically selected to produce a drilling fluid having a desired set of properties. Thus, as is known in the art, drilling fluids typically include weighting agents such as barite to increase density, viscosifiers such as clays to thicken the fluid, and other optional additives such as emulsifiers, fermentation control agents, and the like. While both water- and oil-based muds are common, the present invention relates primarily to water-based muds.

The density of the drilling fluid is typically selected such that at the bottom of the borehole, the hydrostatic head of the drilling fluid will be greater than the fluid pressure naturally present in the formation that is being drilled. It is desirable for the fluid pressure to exceed the formation pressure in order to prevent an uncontrolled or undesired ingress of formation fluids into the well. Because the fluid pressure exceeds the formation pressure, the liquid portion of the drilling fluid can invade the formation, changing the composition of the fluids in the rock in the vicinity of the borehole. When liquid leaks into the formation in this fashion, the solids in the drilling fluid tend to be filtered out on the face of the formation, forming a filter cake, while the liquid portion, known as filtrate, seeps into the pores and interstices in the rock. The same phenomenon often results in the seepage of drilling fluid filtrate into core samples.

One result is that a the contaminated core sample, when retrieved, can no longer provide the desired accurate information about the composition of formation fluids. Hence, when a core is analyzed, it is important to know whether and to what degree the core has been invaded by filtrate from the drilling fluid. To that end, it is common to include a tracer chemical in the drilling fluid when it is important the degree of drilling fluid invasion must be determined.

There are many criteria that are required of an effective tracer material. For example, tracer materials must be selected to avoid undesired effects on drilling fluids and chemicals. Likewise, their absorption characteristics on the filter cake or in the formation, their solubility, and effects on drilling equipment and related facilities are important, as are cost and hazard to drilling and core handling personnel. Hence, there remains a need for a tracer material that is inexpensive and effective and avoids the drawbacks of existing tracer materials.

SUMMARY OF THE INVENTION

The present invention provides a tracer material that is inexpensive and effective and avoids the drawbacks of existing tracer materials. Specifically, the present tracer is soluble in water, essentially non-naturally occurring, readily detectible, stable under downhole conditions, biologically inert, not significantly surface active, readily available, and safe.

According to a preferred embodiment, a cesium salt, preferably cesium formate, is used as a tracer in coring operations. Cesium is included in the drilling fluid at a concentration that is greater than its concentration in the surrounding formation. Core samples are then tested to measure the degree of infiltration of the drilling fluid filtrate by measuring the level of cesium, and thus the degree of infiltration of the drilling fluid into in the core sample fluid.

Hence, in one embodiment, the infiltration of coring fluid into a core sample taken from a formation can be measured by a) providing a coring fluid containing cesium in a first concentration, b) using said coring fluid and a coring means to generate the core sample, c) determining the concentration of cesium present in the core sample, and d) comparing the core sample cesium concentration to the first concentration. The results of the comparison in step d) to calculate the degree of infiltration of the coring fluid into the core sample.

In various preferred embodiments, the step c) is performed using ICP-MS and may include disaggregation or centrifugation. Alternatively, a displacing fluid can be used to displace fluid from the core sample. The cesium concentration in the coring fluid is preferably between 25 ppb and 250 ppm and more preferably between 25 ppb and 125 ppm, but the cesium concentration in the coring fluid may be at least 25 ppm. The present method can be used when cesium is present as a weighting agent in the coring fluid.

DETAILED DESCRIPTION OF THE PREFERRED EMBODIMENTS

Cesium is used as an effective tracer having many advantageous properties for detecting the degree of infiltration occurring as a result of coring operations. The cesium salt is preferably soluble in water up to concentrations well above the concentrations needed for tracer functionality. In addition techniques for detecting the concentration of cesium in a fluid readily allow detection at levels below the levels needed for meaningful analyses.

The present invention provides a tracer material that is inexpensive and effective and avoids the drawbacks of existing tracer materials. Specifically, the present tracer is soluble in water, essentially non-naturally occurring, readily detectible, stable under downhole conditions, biologically inert, not significantly surface active, readily available, and safe.

According to a preferred embodiment, a cesium salt is added to the coring fluid in an amount that will result in the concentration of cesium in the total mud volume being such that when as little as 1%–2% of the mud invades the core the concentration in the core will be preferably at least twice, more preferably at least three times, still more preferably at least 10 times, and optionally at least 20 times, the naturally occurring concentration of cesium in the formation. Cesium occurs naturally in seawater at concentrations of about 400 parts per trillion (ppt) (by mass). The concentration of cesium in other naturally occurring contexts is not expected to vary greatly from this level. In one embodiment, then, a generous estimate of the maximum cesium concentrations likely to be encountered in nature is 4,000 ppt, or 4 parts per billion (ppb) (by mass). Assuming this hypothetical maximum allows concentration of a hypothetical minimum concentration that would always provide at least a ten-fold factor between the resultant invaded concentration in the core and the noninvaded concentration in the formation, namely 40 ppb. Therefore, for example, to obtain 40 ppb in the core with a 2% invasion one would need a concentration 50× higher in the drilling fluid, specifically 2 ppm as the threshold level. To obtain a 1% resolution of core invasion one would need a concentration 100× higher in the drilling fluid, specifically 4 ppm as the threshold level. Because there is the possibility of cesium concentration dilution it is safer to spike the drilling fluid to a larger concentration than necessary. Therefore by spiking the drilling fluid to ten times the threshold level one ensures in all practical cases that dilution will never hinder the resolution for the determination of drilling fluid contamination in the core.

The preferred cesium salts include cesium formate and cesium chloride, but any salt of cesium that is safe, stable, and sufficiently soluble in water can be used. Cesium formate is commercially available. If the cesium salt could be functionalized such that it would be soluble in a non-polar solvent the cesium could be used as a tracer in an organic coring fluid.

According to one preferred embodiment, a desired coring fluid formulation is generated in a conventional manner, taking into account the desired mud weight and other factors, and the coring fluid is mixed according to the desired formulation. The cesium salt is added to the desired mud formulation in an amount sufficient to give a desired cesium concentration in the resulting fluid. The desired coring fluid formulation may or may not include cesium compounds. If cesium is used as a weighting agent, for example, the concentration of cesium in the fluid will far exceed the desired minimum concentration needed to measure infiltration and no additional cesium will be necessary. Alternatively, if the desired coring fluid formation would not otherwise contain cesium, the cesium tracer can be added without concern that the properties of the drilling fluid, such as fluid density, will be significantly altered, since the target concentration of cesium is relatively very low.

Once the cesium-containing coring fluid has been mixed, it can be used in a conventional manner in a core drilling operation. In general, the cesium-containing coring fluid is pumped downhole as the coring bit is rotated. As the fluid returns to the surface, it carries with it cuttings generated by the drilling. Throughout the coring operation, the coring fluid will tend to infiltrate the core to a greater or lesser extent. Various mechanical and other devices are used to minimize infiltration. For example, core sleeves or liners can be used to contain the core as it is generated. Alternatively, a particulate such as calcium carbonate can be used so that, as the liquid portion of the drilling fluid seeps into the rock, it leaves behind on the rock surface a filter cake comprising the particulate solids, which in turn reduces the permeability of the rock and thus reduces infiltration.

When a core sample of the desired length has been formed, it is broken off and tripped out of the well. Regardless of the infiltration inhibitor(s) used and their effectiveness, it is still necessary to determine quantitatively the degree of liquid infiltration, if any, that has entered the core sample.

It is most preferable to analyze the fluid in the core both to derive the properties of the natural formation fluids, and the extent of contamination while keeping the solid portions of the core as undisturbed as possible. For this reason the fluid contents of the core, including any material dissolved therein, are preferably removed by disaggregation or centrifugation. Alternatively the fluid contents of the core can be recovered by pulverization of the core sample followed by solids separation, by elution, by laser ablation followed by gas analysis, or any other suitable technique.

The chemical composition of the resulting liquid is preferably analyzed using Inductively Coupled Plasma—Mass Spectroscopy (ICP-MS). In order to enable the ICP-MS device to detect the cesium tracer, which may be present in only minute amounts, the device is preferably pre-calibrated to adjust for the presence of other elements or compounds that might be present. Similarly, it is preferred to dilute the sample stream by a factor of at least 100 and more preferably at least 200–300 over the invaded formation fluid concentration in order minimize adverse analytical effects known in the art. Because the extraction step may dilute the concentration of the invaded formation fluid by a known amount, a full 100–300-factor dilution may not necessary. The preferred diluent is deionized (DI) water. In alternative embodiments, other analysis techniques can be used, including but not limited to Inductively Coupled Plasma Optical Emission Spectroscopy, atomic adsorption, ion chromatography, laser induced breakdown spectroscopy and x-ray florescence. The optimal concentration may however vary with suggested techniques and higher spike concentrations may be necessary thereby reducing the economical attractiveness.

In order to provide accurate comparative data, at least one sample of the coring fluid is preferably taken from the well at the time that the core sample is generated is analyzed in a like manner. Because the coring fluid contains the cesium tracer, the amount of coring fluid present in a sample of fluid from the core plug can be obtained by comparing the results of the analysis of the fluid in the core plug to the results of the analysis of the coring fluid. This will yield the total core fluid contamination over the length of a core plug where a core plug is sub-sampled from the core.

Cesium formate is advantageous because it does not damage formations and does not exchange with the cations of clays typically found in formations, nor does it absorb onto the formation surfaces. Likewise, cesium formate is stable under downhole conditions, biologically inert, biodegradable, and safe when handled correctly.

The following Example sets out representative ranges for some of the parameters that are relevant to the present invention. It is intended to be illustrative and not limiting on the claims that follow.

The presently available ICP-MS machines can easily and routinely detect cesium at levels as low as 83 ppt. Because the sample is preferably diluted by a factor of 300 prior to processing, however, the effective lower limit of detection is approximately 25 ppb. In a preferred embodiment, this minimum is increased still further because the coring fluid is likely to be present in the core at levels well below 100 percent. If a desired minimum level of detectable infiltration is set at 1 percent, for example, the lower limit of concentration in the coring fluid increases to 2500 ppb, or 2.5 ppm. Put another way, it would be necessary to provide a cesium concentration of at least 2.5 ppm in the coring fluid in order to ensure detectability of the tracer in a sample of core fluid containing 1 percent infiltrated coring fluid. In one preferred embodiment, this minimum is multiplied by a safety factor, such as 20, 50, or 100. Even without the preferred safety multiplier, the get minimum concentration is orders of magnitude greater than naturally occurring concentrations of cesium, ensuring that the presence of naturally occurring cesium in the core sample will not adversely affect the ability to assess infiltration.

While the present invention has been disclosed and described with reference to certain preferred embodiments, it will be understood that variations could be made thereto with departing from the scope of the claims. For example, soluble cesium salts other than cesium formate can be used, analysis of the core sample can be performed using any suitable technique.

Likewise, unless explicitly so stated, the sequential recitation of steps in the claims that follow is not intended as a requirement that the steps be performed in any particular order, or that any step must be completed before commencement of another step.

What is claimed is:

1. A method for measuring the infiltration of coring fluid into a core sample taken from a formation, comprising:

a) providing a coring fluid containing cesium in a first concentration;

b) using said coring fluid and a coring means to generate the core sample;

c) determining the concentration of cesium present in the core sample; and d) comparing the core sample cesium concentration to the first concentration;

wherein the cesium concentration in the coring fluid is between 25 ppb and 250 ppm.

2. The method according to claim 1, further including the step of using the results of the comparison in step d) to calculate the degree of infiltration of the coring fluid into the core sample.

3. The method according to claim 1 wherein step c) is performed using ICP-MS.

4. The method according to claim 1 wherein step c) includes disaggregation or centrifugation.

5. The method according to claim 1, further including the step of e) using the results of the comparison in step d) to calculate the degree of infiltration of the coring fluid into the core sample.

6. The method according to claim 1, further including using a device for reducing the amount of coring fluid that infiltrates the core sample during step b).

7. The method according to claim 1 wherein step c) includes using a displacing fluid to displace fluid from the core sample.

8. The method according to claim 1 wherein the cesium concentration in the coring fluid is between 25 ppb and 125 ppm.

9. The method according to claim 1, further including using cesium as a weighting agent in the coring fluid.

10. A method for measuring the infiltration of coring fluid into a core sample taken from a formation, comprising:

a) providing a coring fluid containing cesium in a first concentration;

b) using said coring fluid and a coring means to generate the core sample;

c) determining the concentration of cesium present in the core sample; and d) comparing the core sample cesium concentration to the first concentration;

wherein the cesium concentration in the coring fluid is at least 25 ppm.

11. The method according to claim 10 wherein step c) is performed using ICP-MS.

12. The method according to claim 10 wherein step c) includes disaggregation or centrifugation.

13. The method according to claim 10, further including the step of e) using the results of the comparison in step d) to calculate the degree of infiltration of the coring fluid into the core sample.

14. The method according to claim 10, further including using a device for reducing the amount of coring fluid that infiltrates the core sample during step b).

15. The method according to claim 10 wherein step c) includes using a displacing fluid to displace fluid from the core sample.

16. The method according to claim 10 wherein the cesium concentration in the coring fluid is between 25 ppm and 125 ppm.

17. The method according to claim 10, further including using cesium as a weighting agent in the coring fluid.

18. A method for measuring the infiltration of coring fluid into a core sample taken from a formation, comprising:

a) providing a coring fluid containing cesium in a first concentration;

b) generating the core sample in the presence of said coring fluid;

c) determining the concentration of cesium present in the core sample; and d) comparing the core sample cesium concentration to the first concentration;

wherein the cesium concentration in the coring fluid is between 25 ppb and 250 ppm.

19. A method for measuring the infiltration of coring fluid into a core sample taken from a formation, comprising:

a) providing a coring fluid containing cesium in a first concentration;

b) using said coring fluid and a coring means to generate the core sample;

c) determining the concentration of cesium present in the core sample; and d) comparing the core sample cesium concentration to the first concentration;

wherein the cesium concentration in the coring fluid is at least 25 ppb.

20. A method for measuring the infiltration of coring fluid into a core sample taken from a formation, comprising:

a) providing a coring fluid containing cesium in a first concentration;

b) using said coring fluid and a coring means to generate the core sample;

c) determining the concentration of cesium present in the core sample; and d) comparing the core sample cesium concentration to the first concentration;

wherein the cesium concentration in the coring fluid is at least 2.5 ppm.

* * * * *